United States Patent [19]

Joubert

[11] Patent Number: 4,830,543

[45] Date of Patent: May 16, 1989

[54] FOUNDATION SUPPORT FOR A BUILDING

[76] Inventor: Johannes W. Joubert, P.O. Box 6650, Pretoria 0001, Transvaal Province, South Africa

[21] Appl. No.: 925,287

[22] Filed: Oct. 31, 1986

[30] Foreign Application Priority Data

Nov. 4, 1985 [ZA] South Africa ..... 85/8439
Apr. 4, 1986 [ZA] South Africa ..... 86/2526

[51] Int. Cl.[4] ..... E02D 5/66

[52] U.S. Cl. ..... 405/233; 249/13; 405/229; 405/232

[58] Field of Search ..... 405/232, 233, 235-243, 405/231, 216; 249/11-13

[56] References Cited

U.S. PATENT DOCUMENTS

| | | | |
|---|---|---|---|
| 1,062,718 | 5/1913 | Layne | 405/239 |
| 1,629,947 | 5/1927 | Blumenthal | 405/243 |
| 1,954,094 | 4/1934 | Newman | 405/242 X |
| 2,140,111 | 12/1938 | Newman | 405/239 |
| 3,180,099 | 4/1965 | Mikolajczyk et al. | 405/216 |
| 3,256,694 | 6/1966 | Siedenhans | 405/236 |
| 3,396,546 | 8/1968 | Pleuger | 405/243 |
| 3,685,302 | 8/1972 | Fuller | 405/237 |
| 3,832,859 | 9/1974 | Kanjanavanit | 405/236 |
| 4,355,927 | 10/1982 | Stephan | 405/233 |
| 4,464,083 | 8/1984 | Wathey | 405/216 |
| 4,648,220 | 3/1987 | Gebelius | 405/237 X |
| 4,673,157 | 6/1987 | Wells | 249/13 |

FOREIGN PATENT DOCUMENTS

| | | | |
|---|---|---|---|
| 197801 | 1/1978 | German Democratic Rep. | 405/233 |
| 3383 | 6/1919 | Netherlands | 405/237 |
| 1021713 | 6/1983 | U.S.S.R. | 405/242 |

OTHER PUBLICATIONS

Engineering News, vol. 68, No. 9, 8/1912.

The Civil Engineer in South Africa—Jul. 1985, pp. 367 and 373.

Fourth Regional Conference for Africa on Soil Mechanics and Foundation Engineering Dec. 1967, p. 249.

Guide to Piling and Foundation Systems Frankipile South Africa (Pty) Limited—Jan. 1976, pp. 1-4, 18-19, 25-27, 29-30, 34-35, 37-39, 46, 48-49, 58-60, 63-64, 96-97 and 109.

*Primary Examiner*—Dennis L. Taylor

*Attorney, Agent, or Firm*—Fitch, Even, Tabin & Flannery

[57] ABSTRACT

A method of providing a foundation support in unstable ground includes digging a hole into the soil until a stable substrate is reached, erecting column shuttering, backfilling the soil around the column shuttering, and casting a cementitious mix into the cavity defined by the column shuttering to form a column extending upwardly from the stable substrate. A footing is formed at the bottom of the hole e.g. by pouring a settable cementitious mix into the hole. Footing shuttering can be provided e.g. in the form of an inverted frustoconical shell or a hemi-spherical shell, or formed from bendable sheet material, shaped to an appropriate form and secured together e.g. by stapling, or it can be made up of trapezoidal panels which are assembled to form a flat topped hollow pyramid.

7 Claims, 3 Drawing Sheets

FOUNDATION SUPPORT FOR A BUILDING

FIELD OF THE INVENTION

This invention relates to providing a foundation support for a building in unstable ground.

BACKGROUND OF THE INVENTION

In some soils, having a high clay content, it is necessary to take special steps, to provide a stable foundation because of the tendency of the soil to move as a result of variations in the moisture content of the soil. It is customary therefore, to dig down through the unstable portion of the soil, until a stable substrate is reached and then to provide a footing on such stable substrate for the building which is then to be built above the layer of unstable soil.

The costs of driving piles down to a stable substrate can be very high. It is an object of the present invention to provide a method for providing a foundation on unstable ground which, it is believed, will be less expensive than other methods known to the Applicant.

SUMMARY OF THE INVENTION

In accordance with the invention a method of providing a foundation support in unstable ground includes digging a hole into the soil until a stable substrate is reached;

erecting column shuttering for the casting of a concrete column within the hole;

back-filling the soil around the column shuttering; and casting a cementitious mix into the cavity defined by the column shuttering to form a column extending upwardly from the stable substrate.

A footing may be formed at the bottom of the hole by pouring a settable cementitious mix into the hole.

In another embodiment, the footing may be formed by pouring a settable mortar mix into the hole to level off the bottom of the hole and locating a prefabricated concrete footing on the mix.

If desired, the backfilling may take place before the settable cementitious mix has been poured into the cavity defined by the column shuttering. Alternatively, the back-filling may take place after the settable cementitious mix has been poured into the cavity defined by the column shuttering. If desired, reinforcement may be provided within the column shuttering before pouring of the settable cementitious mix. The reinforcement may be in the form of a cage of steel rods. When the footing is formed by pouring a settable cementitious mix into the hole, the steel rods may be placed in position, before the footing has set so that the lower ends of the steel rods may be pushed into the footing to ensure an adequate purchase by the steel rods in the footing.

The column shuttering may be of a synthetic plastics material. Alternatively, it may be of a biodegradable material, such as wood or cardboard. This will ensure that when it eventually rots, there will be clearance between the column and the surrounding soil, thereby allowing some room for expansion and contraction of the unstable portion of the soil above the stable substrate and below the building which is then built on top of the column and other similar columns.

In practice, a plurality of columns will be provided in this fashion, spaced circumferentially around the periphery of a building, and even within such periphery.

The column shuttering may comprise an inner and an outer member, the outer member being axially displacable relative to the inner member. The inner and outer members may be concentric round-cylindrical pipes, eg of bitumen-impregnated cardboard.

If desired, footing shuttering may be provided at the bottom of the hole, below the level of the column shuttering. Such footing shuttering may be in the form of an inverted frusto-conical shell, or it may be in the form of a hemi-spherical shell. Alternatively, the footing shuttering may be formed from bendable sheet material, shaped to an appropriate form and secured together eg by stapling.

Alternatively, the footing shuttering may be made up of trapezoidal panels which are assembled to form a flat topped hollow pyramid. The opening at the top of the pyramid can then receive the lower end of the colum shuttering spigot-fashion whereafter the casting of concrete and the back-filling can take place.

The invention extends to footing shuttering in the form of a frusto-conical or hemi-spherical shell.

The invention extends further to a panel which is adapted to form footing shuttering with other similar panels.

The invention also extends to a shaped blank of bendable sheet material for forming downwardly diverging footing shuttering.

The invention extends still further to a prefabricated concrete footing for use in forming a foundation support as described above, said footing having keying elements projecting outwardly from a face thereof.

BRIEF DESCRIPTION OF THE DRAWINGS

The invention will now be described by way of example with reference to the accompanying diagrammatic drawings.

In the drawings.

DESCRIPTION OF THE PREFERRED EMBODIMENTS

Figure 1:
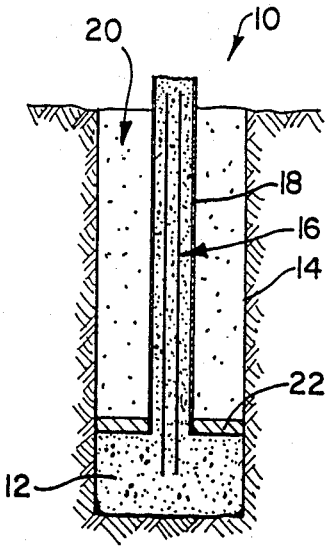
FIG. 1 shows a sectional side elevation of one embodiment of a foundation support when made in accordance with the method of the invention.

Referring to the drawings, reference numeral 10 refers to a foundation support which comprises a footing 12 of a settable cementitious mix, in the bottom of hole 14. Before setting of the cementitious mix 12, steel reinforcing rods 16 are erected. Tubular column shuttering 18 of cardboard or of synthetic plastic pipe, is erected around the rods 16. Thereupon soil 20 is backfilled into the hole 14. Cementitious mix, is then poured into the cavity formed by the column shuttering 18 so as to form the foundation support 10.

The hole 14 may be dug by making use of mechanical means, such as back actor or an auger, or the like.

If desired, before back-filling the soil 20, a cover 22 in the form of cardboard or plank, may be provided on top of the footing 12.

In use, the plank 22 and the column shuttering 18, will remain permanently in position. The timber and cardboard will eventually rot away leaving some clearance space, to permit variation in volume of the backfill material 20 and surrounding soil. When the column shuttering 18 is of plastic pipe, it will remain smooth thus permitting the backfill material 20, to slide relatively to the pipe 18.

Figure 2:
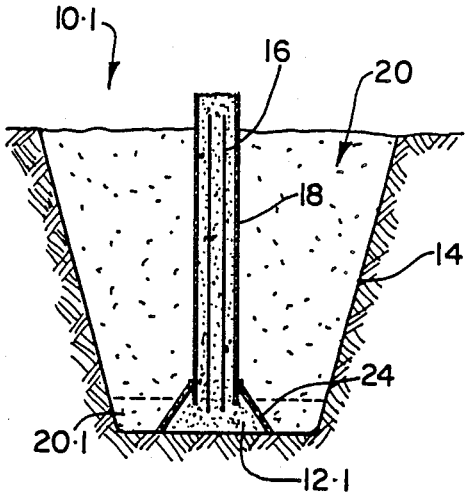
FIG. 2 shows a sectional side elevation of another embodiment of a foundation support when made in accordance with the method of the invention.
Figure 3:
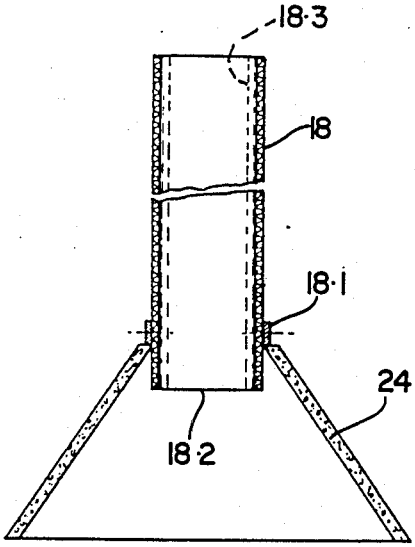
FIG. 3 shows a sectional side elevation of column and footing shuttering for the foundation support of FIG. 2, but to a larger scale.

Referring to FIGS. 2 and 3 of the drawings, the procedure is similar to that described with reference to FIG. 1 excepting that the footing 12.1, is itself defined by footing shuttering 24 in the form of a frusto-conical concrete shell placed at the bottom of the hole 14 which is dug down to a depth where stable ground is available. The steel reinforcement 16 and the column shuttering 18 are erected, and the back-fill of the soil 20 takes place. After back-fill of the soil 20, cementitious mix is poured into the cavity defined by the concrete shell 24 and column shuttering 18.

In order to locate the tube 18 axially in position relative to the concrete shell 24, the tube 18 is provided with a shoulder 18.1 secured inwardly from the end 18.2 of the pipe 18. Thereby the end 18.2 fits spigot-fashion into the upper open end of the concrete shell 24.

In FIG. 3 of the drawings, there is shown an optional tubular column shuttering 18.3 located telescopic fashion within column shuttering 18, the colum shuttering or outer member 18 being slidably displacable relative to the column shuttering or inner member 18.3. The inner member 18.3 and the outer member 18 may be of bitumen impregnated cardboard. The slidable outer member 18 counteracts any tendency for the unstable soil to grip and urge the foundation support 10 out of the ground. The bitumen also acts as a preservative for the cardboard pipes.

Figure 4:
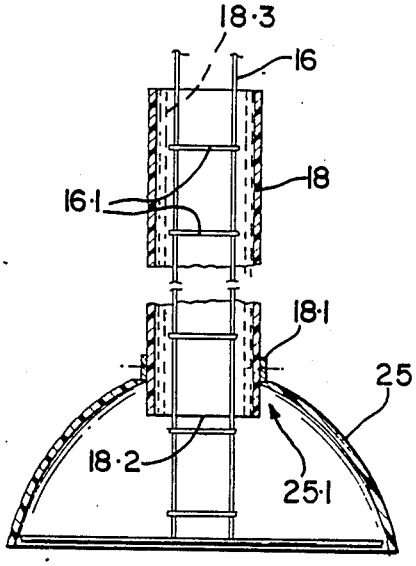
FIG. 4 shows a sectional side elevation of column and footing shuttering of another embodiment of a foundation support when made in accordance with the invention.

Referring to FIG. 4 of the drawings, the procedure is similar to that described with reference to FIGS. 2 and 3, excepting that the footing shuttering is in the form of a hemi-spherical shell 25 of synthetic plastics material. In this embodiment the tube 18 is also of synthetic plastics material and the spigot type formation 18.2 of column shuttering 18 fits into an opening 25.1 at the top of the shell 25. Reinforcement in the form of steel reinforcing rods 16 is provided, optionally bound together at spaced longitudinal positions by binders 16.1.

In a similar manner to that shown in FIG. 3, the column shuttering of FIG. 4 comprises an inner member 18.3 and an outer member 18 slidably located on the inner member 18.3. The inner member 18.3 is optional, and may be omitted if desired.

Figure 5:
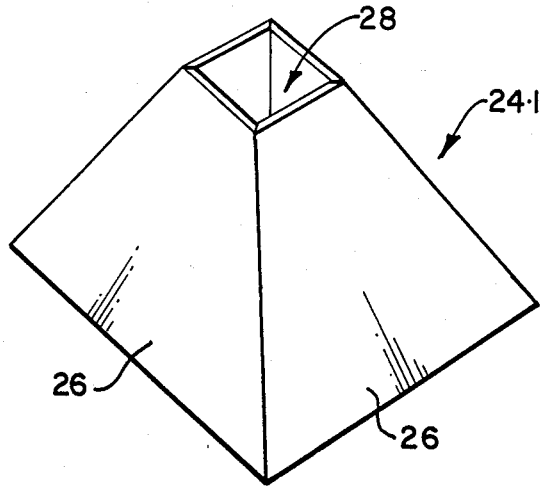
FIG. 5 shows a three dimensional view of footing shuttering comprising flat panels, for providing an alternative form of footing shuttering to that shown in FIG. 3.
Figure 6:
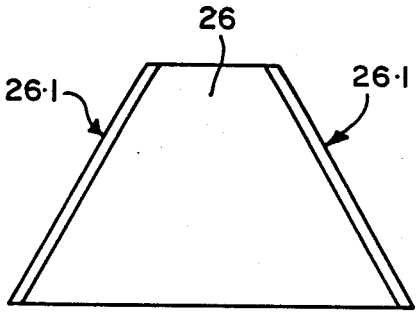
FIG. 6 shows a side elevation of a panel used in FIG. 5.

Referring to FIG. 5 of the drawings, there is shown another type of shuttering 24.1 in which the shuttering is made up of concrete panels 26 of quadrilateral form shaped so that when fitted together, they form a hollow flat top pyramid having an opening at the top 28, within which the spigot-type formation 18.2 of column shuttering 18 may fit. The panels 26 have bevelled edges 26.1 so that they can fit snugly together.

Figure 7:
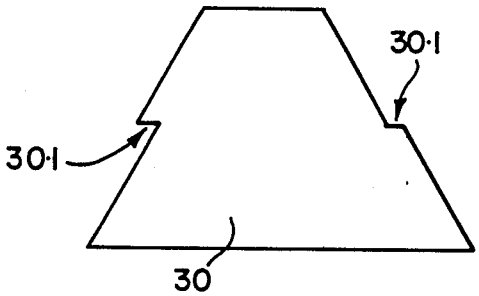
FIG. 7 shows an alternative form of panel for making footing shuttering of generally the same flat top hollow pyramidal type shown in FIG. 5.

Referring to FIG. 7 of the drawings, there is shown an alternative form of panel having rebates 30.1 so as to ensure that four panels 30 can fit together to form footing shuttering of flat-topped hollow pyramidal form similar to that shown in FIG. 4 of the drawings.

Figure 8:
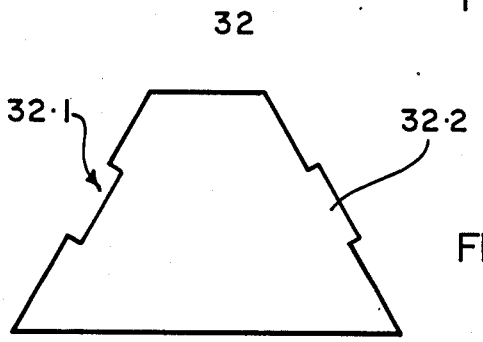
FIG. 8 shows a side elevation of yet a further alternative form of panel for making footing shuttering of the hollow pyramidal type shown in FIG. 5.

Referring to FIG. 8 of the drawings, there is shown a further alternative form of panel 32 having a rebate 32.1 and a projection 32.2 which co-operate male-female fashion, with other similar rebates and projections to form footing shuttering of flat topped pyramidal form, similar to that shown in FIG. 4.

Figure 9:
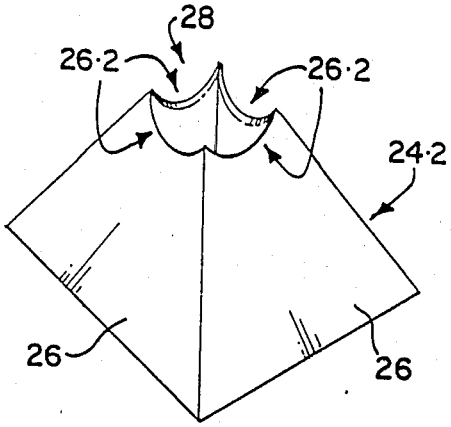
FIG. 9 shows a three-dimensional view of footing shuttering similar to FIG. 5.
Figure 10:
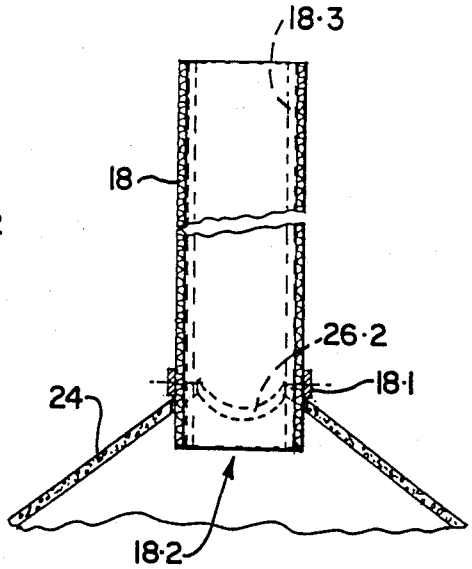
FIG. 10 shows a sectional side elevation of column shuttering, with footing shuttering of FIG. 9.

Referring to FIGS. 9 and 10 of the drawings, there is shown footing shuttering 24.2 similar to that shown in FIG. 5, made up of panels 26 having cut-outs 26.2 to accommodate snugly the spigot end 18.2 of the pipe 18 as shown in FIG. 10.

Figure 11:
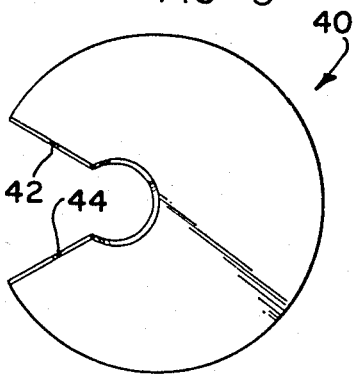
FIG. 11 shows a developed plan view of bendable sheet material for making footing shuttering to form a frusto-conical footing.

Referring to FIG. 11 of the drawings, there is shown in developed plan view, a blank 40 cut from a bendable sheet material such as cardboard, for forming footing shuttering of frusto-conical form by blending it so that the edges 42 and 44 overlap, and stapling them together.

Figure 12:
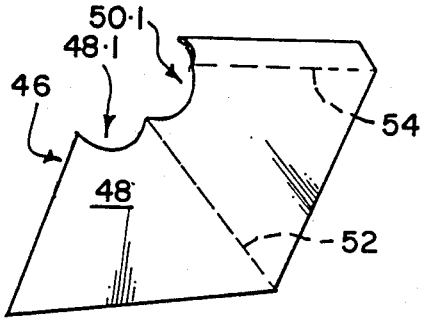
FIG. 12 shows a developed plan view of bendable sheet material for making footing shuttering of the hollow pyramidal type shown in FIG. 9.

Referring to FIG. 12, there is shown in developed plan view, a blank 46 cut from a bendable sheet material such as cardboard, and having panels 48 and 50 with cut-outs 48.1 and 50.1. The panels 48 and 50 are separated by a fold line 52. The panel 50 has a stapling flap separated from panel 50 by a fold line 54. In use, two blanks 46 are assembled together and stapled along overlapping edges to form footing shuttering resembling the shuttering of FIG. 9.

When using footing shuttering 24 formed from cardboard or synthetic plastic sheet blanks 40 or 46 for a footing 12.1, then a first layer 20.1 of backfill soil 20 may be filled back into the hole, around such shuttering, to a level at the most as high as the shuttering 24. Then settable cementitious mix, is poured into the cavity defined by shuttering 24 whereafter the reinforcement 16 and the column shuttering 18 are erected. Thereupon further backfilling around column shuttering 18 can taken place, and finally the cementitious mix can be poured into the cavity defined by the column shuttering 18.

Figure 13:
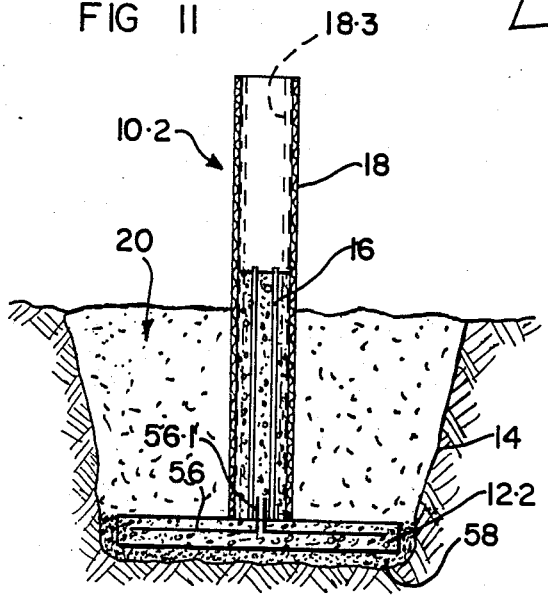
FIG. 13 shows a sectional side elevation of yet another embodiment of a foundation support when made in accordance with the invention.

Referring to FIG. 13 of the drawings, reference numeral 10.2 refers to a foundation support which comprises a footing in the form of a prefabricated concrete slab 12.2. The slab 12.2 is reinforced with steel rods 56 which have ends 56.1 projecting outwardly and transversely of the slab 12.2 to form keying elements for the concrete of the column.

In this embodiment, the hole 14 as before is dug down to a depth at which stable ground is available. A sufficient amount of a settable mortar mix 58 is then poured into the bottom of the hole 14. The slab 12.2 is then located on the upper surface of the layer 58 and bedded down level, with the keying elements 56.1 directed upwardly. Steel reinforcing rods 16 are erected on the slab 12.2 and column shuttering 18 of cardboard is erected around the rods 16 and the keying elements 56.1. Thereupon soil 20 is backfilled into the hole 14. Cementitious mix is then poured into the cavity formed by the column shuttering 18 so as to form the foundation support 10.2. It should be noted that the cardboard tubing 18 is usually available in standard lengths and it can be cut off at any desired height above the level of the soil 20.

In a similar manner as described with reference to FIG. 3, the column shuttering may comprise an inner member 18.3 (shown in dotted lines) and an outer member 18, axially slidable relative to each other.

From the drawings it is clear that the column shuttering 18 and 18.3 have smooth, imperforate inner surfaces, and that the inner diameters of the column shuttering 18 and 18.3 are less than one-third the maximum transverse dimension of the footings 12, 12.1 and 12.2 or of the footing shuttering 24, 24.1, 24.2 and 25.

The Applicant believes that foundation supports in accordance with the invention can be inexpensively made, and can be economically used for low cost housing.

What I claim is:

1. A method for providing a foundation support in unstable ground having a stable substrate subsurface, which method includes:

providing footing shuttering and column shuttering, both having an internal cavity and a base and both suitable for providing a casting form for a cementitious mix introduced therein;

forming a support base on the stable substrate subsurface by digging a hole into the soil so as to expose a portion of the stable substrate subsurface;

inserting the footing shuttering in the hole;

engaging the base of the footing shuttering with the substrate subsurface so that the stable substrate provides support for a cementitious footing cast in the footing shuttering;

inserting column shuttering in the hole;

supporting the base of the column shuttering on the footing shuttering so as to produce with the footing shuttering a casing form for the casting of a cementitious structure therewithin;

providing a smooth imperforate inner surface in the interior of the column shuttering so that the column shuttering is slidable about a column which is formed by casting a cementitious mix in the column shuttering;

back-filling the hole with soil so as to surround both the footing and the column shuttering: and forming a cementitious support having a smooth surfaced column and a footing, by casting a cementitious mix into the cavity defined by the footing shuttering and the column shuttering so as to form a footing supported by the stable substrate and a column with a smooth surface so as to be slidable within the column shuttering and extending upwardly from the footing;

whereby, under unstable conditions because of variations in moisture content in the backfill and surrounding soil, differential movement is permitted between the column shuttering and the backfill soil in contact therewith, and the column formed inside the column shuttering.

2. A method as claimed in claim 1, in which the column shuttering is generally tubular and the step of providing the footing shuttering includes the steps of configuring the footing shuttering to have the form of an inverted frustoconical shell having an upwardly directed opening, forming a lip at the opening of the shell and forming a shoulder inwardly extending from the column shuttering adjacent the lower end thereof, and the step of producing the casting form comprises inserting the lower end of the column shuttering in the opening of the shell and supporting the shoulder of the column shuttering on the lip of the shell.

3. A method of providing a foundation support in unstable ground having a stable substrate subsurface, which method includes:

providing column shuttering having an internal cavity and a base and being suitable for providing a casting form for a cementitious mix poured therein;

forming a support base on the stable substrate subsurface by digging a hole into the soil so as to expose a portion of the stable substrate subsurface;

forming a footing by pouring a settable mortar mix into the hole in contact with the stable substrate subsurface and locating a prefabricated concrete slab on the mortar mix;

inserting the column shuttering in the hole;

supporting the base of the column shuttering on the thus formed footing;

providing a smooth imperforate inner surface in the interior of the column shuttering for the casting of a concrete column in the column shuttering, so that the column shuttering is slidable about the cast column;

back-filling the hole with soil so as to surround the column shuttering to hold it in position; and forming a cementitious support having a smooth surfaced column and a footing, by casting a cementitious mix into the cavity defined by the column shuttering so as to form a column with a smooth outer surface so as to be slidable within the column shuttering and extending upwardly from the footing;

whereby, under unstable conditions because of variations in moisture content in the backfill and surrounding soil, differential movement is permitted between the column shuttering and the backfill soil in contact therewith, and the column formed inside the column shuttering.

4. A method as claimed in claim 1, in which the column shuttering is generally tubular and the step of providing the footing shuttering includes the steps of configuring the footing shuttering to have the form of an inverted frustoconical prefabricated cementitious shell having an upwardly directed opening, forming a lip at the opening of the shell and forming a shoulder inwardly extending from the column shuttering adjacent the lower end thereof, and the step of producing the casting form comprises inserting the lower end of the column shuttering in the opening of the shell and supporting the shoulder of the column shuttering on the lip of the shell.

5. A method as claimed in claim 1, in which the base of the footing shuttering has a maximum dimension and the step of providing the column shuttering comprises the step of forming the column shuttering with a tubular configuration having an inner diameter less than one-third the maximum dimension of the base of the footing shuttering.

6. A method of providing a foundation support in unstable ground having a stable substrate subsurface, which method includes;

providing column shuttering having an internal cavity and a base and being suitable for providing a casting form for a cementitious mix poured therein;

forming a support base on the stable substrate subsurface by digging a hole into the soil so as to expose a portion of the stable substrate subsurface;

forming a footing by pouring a cementitious mix into the hole in contact with the stable substrate subsurface;

inserting the column shuttering in the hole;

supporting the base of the column shuttering on the thus formed footing;

providing a smooth imperforate inner surface in the interior of the column shuttering for the casting of a concrete column in the column shuttering, so that the column shuttering is slidable about the cast column;

back-filling the hole with soil so as to surround the column shuttering to hold it in position; and forming a unitary cementitious support having a smooth surfaced column and a footing, by casting a cementitious mix into the cavity defined by the column shuttering so as to form a column with a smooth outer surface so as to be slidable within the column shuttering and extending upwardly from the footing;

whereby, under unstable conditions because of variations in moisture content in the backfill and surrounding soil, differential movement is permitted between the column shuttering and the backfill soil in contact therewith, and the column formed inside the column shuttering.

7. A method as claimed in claim 6, further comprising the step of covering the footing around the lower end of the column shuttering before the step of backfilling soil into the hole around the column shuttering.

* * * * *